United States Patent [19]

Douglass et al.

[11] 4,241,324

[45] Dec. 23, 1980

[54] MAGNETIC CORE FOR ELECTRICAL TRANSFORMERS

[75] Inventors: James D. Douglass, Pittsburgh; Albert T. Chase, Bethel Park, both of Pa.

[73] Assignee: McGraw-Edison Company, Rolling Meadows, Ill.

[21] Appl. No.: 79,695

[22] Filed: Sep. 28, 1979

[51] Int. Cl.[3] ..... H01F 27/24

[52] U.S. Cl. ..... 336/217; 336/218; 336/234

[58] Field of Search ..... 336/214, 215, 216, 217, 336/218, 233, 234

[56] References Cited

U.S. PATENT DOCUMENTS

| | | | |
|---|---|---|---|
| Re. 13,830 | 11/1914 | Wolcott et al. | 336/234 |
| 527,070 | 10/1894 | Packard | 336/234 X |
| 1,013,150 | 1/1912 | Fortescue | 336/215 X |
| 1,091,995 | 3/1914 | Wolcott et al. | 336/234 |
| 1,170,201 | 2/1916 | Weed | 336/234 X |
| 2,340,081 | 1/1944 | Sauer | 336/234 X |
| 2,997,567 | 8/1961 | Connelly | 336/234 X |
| 3,173,117 | 3/1965 | Franklin | 336/216 X |

*Primary Examiner*—Thomas J. Kozma

*Attorney, Agent, or Firm*—Roy A. Ekstrand; Jon Carl Gealow

[57] ABSTRACT

A unique core for an electrical transformer and method of construction thereof is disclosed which is applicable to either shell-form or core-form transformers of either single-phase or multi-phase application. The cross sectional area of the outside core leg and a portion of the yoke outside the electrical coil of the transformer is increased thereby decreasing the magnetic induction of that portion of the core with a concomitant reduction in electrical losses and noise. The structure comprises leg and yoke stacks formed of lamina of grain-oriented steel that are stacked in a laminar relationship such that adjoining edges of the leg and yoke members are periodically overlapped to enhance flux transfer. The core is stacked in such a fashion such that the outside leg members (outside the electrical coil) have additional laminar members periodically interspersed so that there are more outside leg lamina than inside leg lamina thereby increasing the cross-sectional area of the outside legs. Because the unequal leg and yoke lamina produces voids in the core and "sagging" of the laminations, each time an additional outside leg lamina is stacked, a yoke spacer lamina that is shorter than the other yoke lamina but varied in length between minima at the top and bottom of the stack and maximum at center-stack is placed adjacent the extra leg lamina so that the yoke is tapered from the wider outside leg to the narrower inside leg.

7 Claims, 22 Drawing Figures

MAGNETIC CORE FOR ELECTRICAL TRANSFORMERS

BACKGROUND OF THE INVENTION

1. Field of the Invention

This invention relates in general to electrical inductive apparatus, and more particularly, to magnetic core structure for electrical transformers.

2. Description of the Prior Art

Electrical transformers are well known in the art. Power transformers are those transformers used to transmit or distribute power in ratings larger than distribution transformers (usually over 500 KVA or 67 KV). Design of successful commercial transformers requires the selection of a simple form of structure so that the coils may be easy to wind and the magnetic circuit easy to build. At the same time, the mean length of the windings in the magnetic circuit must be as short as possible for a given cross-sectional area, to minimize resistance losses while the cross-sectional area of the magnetic core should be maximized for increased magnetic flux flow.

These apparently conflicting requirements have been partially resolved by practioners in the art by construction of transformer cores in which the core portion not encircled by windings includes extra laminations (thereby reducing magnetic flux density) while the portion encircled by windings remains of reduced size (thereby minimizing mean length of turn).

Two forms of transformers are in common use. When the magnetic circuit takes the form of a ring encircled by two or more groups of primary and secondary windings distributed around the periphery of the ring, the transformer is termed a core-form transformer. When the primary and secondary windings take the form of a common ring which is encircled by two or more rings of magnetic material distributed around its periphery, the transformer is termed a shell-form transformer. The characteristic features of a core-form transformer are a long mean length of magnetic circuit and a short mean length of windings and of a shell-form are short mean length of magnetic circuit and long mean length of windings.

It has been found that when additional core laminations are interleaved in a portion of a transformer core to increase cross-sectional area, that the voids created in the size transition region become greater in some parts of the core than others. This leads to a "sagging" of core laminations in the transition region and less than maximum core material density. In addition this "sagging" and non uniformity of core voids may tend to increase the noise made by the transformer in use.

Transformers, although they are classified as static apparatus, vibrate and radiate audible sound energy. There are two distinct and different sources of this sound energy. One source is auxiliary cooling equipment and the other source is the core of the transformer. Alternating flux flowing in the core laminations causes them to change length by the effect known as magnetostriction. While the magnetostriction affect is very small, being measured in parts per million, it is the principal cause of core noise. The effect is independent of direction of magnetization. Consequently, there are two core extensions per cycle of magnetization which accounts for the fact that the fundamental sound frequency is twice the excitation frequency. Since the magnetostriction characteristic is not a linear function of flux density, many harmonics are also generated. There are also magnetic forces set up between the laminations at the joint region where flux passes from one lamination to the other which also contributes to core noise.

Various means have been attempted to reduce noise produced in transformer cores. For example, U.S. Pat. No. 3,173,177-Franklin discloses one such noise-reducing arrangement for transformers. Franklin utilizes kinked laminations which tend to absorb the magnetrostriction.

There remains, therefore, a need in the art for an improvement in the structure of such laminated variable cross-section area core devices which will permit their use and realization of their advantages without the increased noise and less than optimum core density caused by void variations.

OBJECTS OF THE INVENTION

Accordingly it is a general object of the present invention to provide an improved variable cross-sectional area transformer core.

It is a more particular object of the present invention to reduce the size and variation of voids within the transformer core.

It is a further object of the present invention to reduce the "sagging" of core laminations in variable cross-section area type transformers.

SUMMARY OF THE INVENTION

In a magnetic core in which a plurality of grain-oriented laminations are combined in a stacked-array to form a magnetic flux path including first and second leg portions together with first and second yoke portions and in which the cross-sectional area of the second leg portion is increased relative to the first leg portion by interleaving a plurality of additional grain-oriented leg laminations between selected ones of the laminations, the improvement comprises a plurality of grain-oriented yoke spacer laminations having a dimension orthogonal to the second leg portion which varies between a maximum at the approximate center of the stacked-array and minima at the ends of the stacked-array.

BRIEF DESCRIPTION OF THE DRAWINGS

The features of this invention which are believed to be novel are set forth with particularity in the appended claims. The invention, together with its further objects and the advantages thereof, may be best understood, however, by reference to the following description taken in conjunction with the accompanying drawings, in which like reference numerals identify like elements in the several figures and in which:

DETAILED DESCRIPTION OF THE PREFERRED EMBODIMENT

Figure 1:
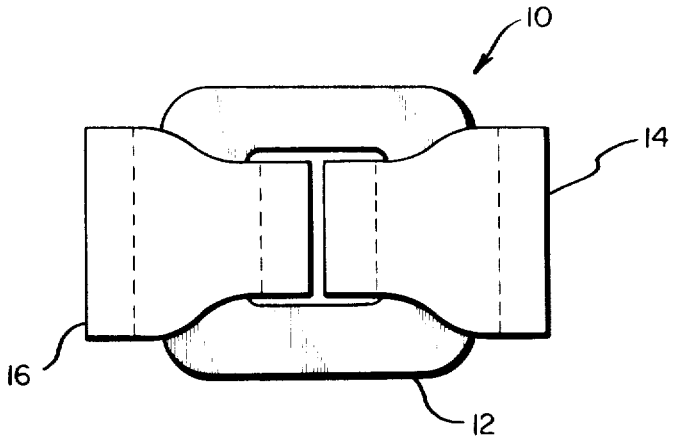
FIG. 1 is a side plan view of a typical shell-form transformer having a core in accordance with the present invention.

With reference to FIG. 1, a shell-form transformer 10 is illustrated. Transformer 10 comprises electrical coils 12 which typically comprise at least one set of primary and secondary windings of the transformer. Coils 12 form the electrical circuit of the transformer 10 and may either comprise a single-phase construction or a multi-phase construction.

Figure 2:
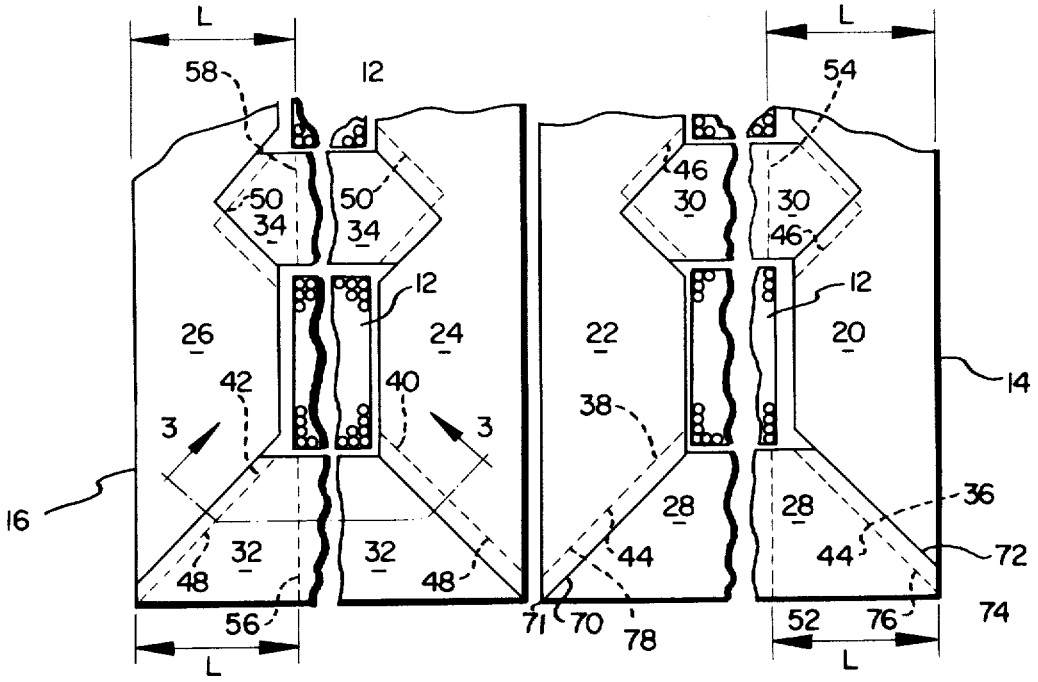
FIG. 2 is a top partially cross-sectional partially fragmentary view of the shell-type transformer of FIG. 1.
Figure 3:
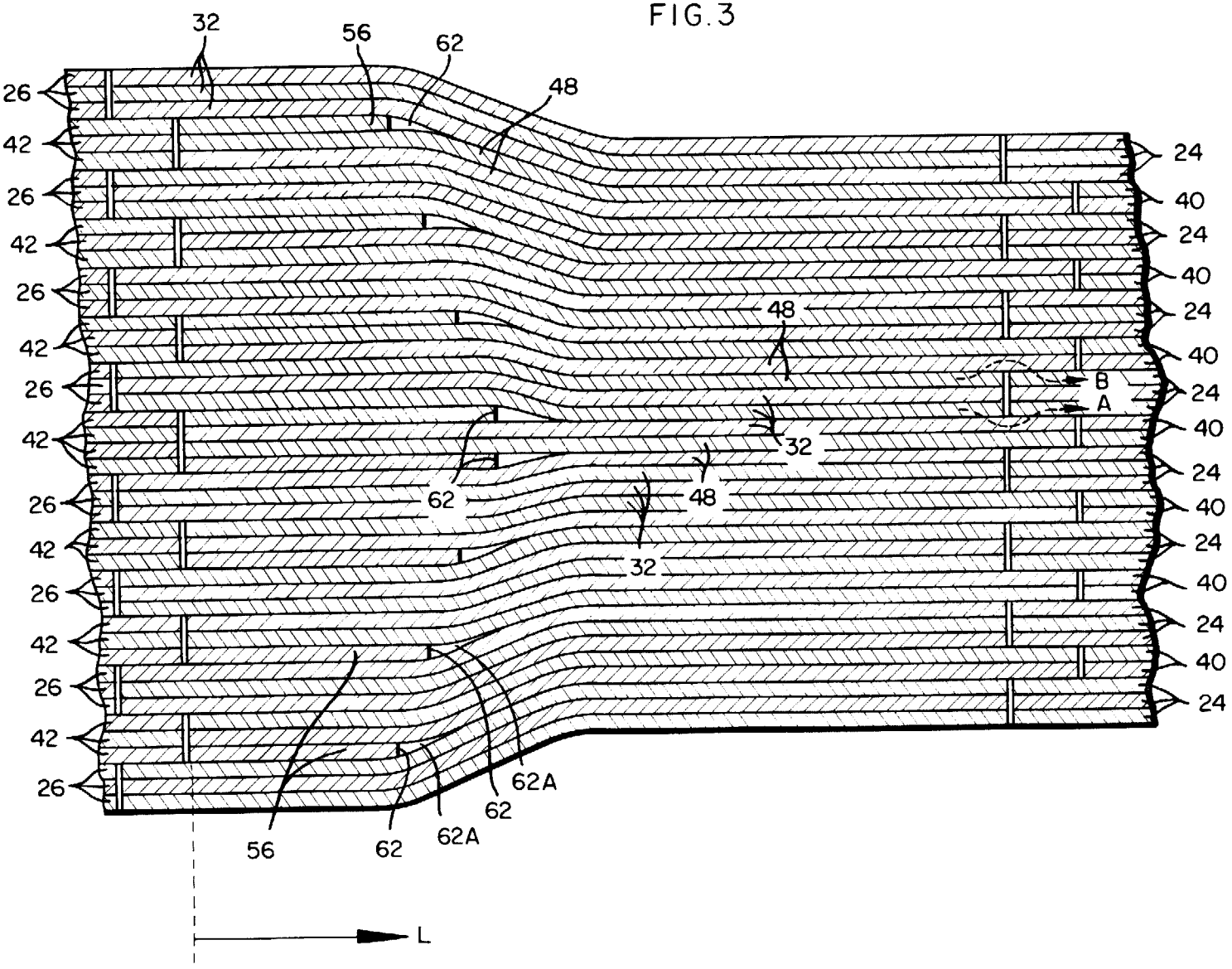
FIG. 3 is a cross-sectional partially fragmentary view taken substantially along line 3—3 in FIG. 2.

The magnetic circuit of the transformer 10 comprises steel cores 14 and 16 which form a magnetic flux conducting path through and around the coils 12. With reference to FIGS. 2 and 3, cores 14 and 16 comprise stacks of thin laminar members most effectively fabricated of grain-oriented electrical steels such as M-4, M-5 and M-6. Grain-oriented electrical steels are iron-silicone alloys that have been developed to provide low core loss and high permeability required for more efficient and economical transformers. These magnetic materials exhibit superior magnetic properties in the direction of grain-orientation. These steels are especially processed to create a very high proportion of grains within the steel which have similarly oriented atomic crystal structure relative to the rolling direction.

The individual laminar members are divided into a variety of specific shapes for the various portions of the cores 14 and 16. Specifically, leg laminar 20, 22, 24 and 26 are shaped as shown in the solid lines in FIG. 2. It should be noted that FIG. 2 only shows one end of a multi-phase transformer coil although the principles of the present invention are equally applicable to either single-phase or multi-phase transformers. Similarly, yoke lamina 28, 30, 32 and 34 are shaped as shown in the solid lines in FIG. 2. FIG. 2 does not show the complete structure for a multi-phase transformer. However, subsequent discussion with respect to FIGS. 4–21 will describe a typical 3-phase core construction. Alternate shapes of the leg and yoke lamina are depicted by the dotted lines in FIG. 2. Thus, there are alternate shaped leg lamina 36, 38, 40 and 42 and alternate shaped yoke lamina 44, 46, 48 and 50. In addition, the core also comprises yoke spacer lamina 52, 54, 56 and 58 (depicted by dotted lines in FIG. 2).

Of particular importance to the present invention is the dimension marked "L" in FIG. 2 for these yoke spacer lamina. As will be described below in greater detail, this dimension is varied as a function of stack position for both alternate forms of yoke spacer lamina.

With reference to FIG. 3, it can be seen that the individual lamina are stacked in a manner to achieve a narrowed core structure for passage throuch coils 12 and an enlarged core structure exterior of the coils 12 as well as a transitional area there between. While the stacking of lamina viewable in FIG. 3 will be described, it should be understood that yoke lamina 30, 34, 46 and 50 are similarly stacked. As can be observed in FIG. 1, the shape of cores 14 and 16 are substantially symetrical about the center of lamina stacking (i.e. the horizontal center plane). Therefore the description of the center-to-top of FIG. 3 will be detailed initially, it being understood that the center-to-bottom lamina "mirror" the center-to-top lamina. Accordingly, beginning at the center layer of FIG. 3, it can be seen that two leg lamina 40, two yoke lamina 48 and four leg lamina 42 are stacked as shown. A yoke spacer lamina 56 which also carries flux is stacked on lamina 48 adjacent the junction to lamina 42 and 48. Next, three leg lamina 24, three yoke lamina 32 and three leg lamina 26 are stacked on top of the preceding layer. However, at the edge 62 of yoke spacer lamination 56, yoke lamina 32 bend due to the spacing of the additional leg lamination and yoke spacer lamination which extends over a portion of the core leg section. There is therefore a void 62A created between lamina.

Next, two leg lamina 40, two yoke lamina 48 and three leg lamina 42 are stacked along with another yoke spacer member 56 in the manner previously described. Thus, when the next layer of lamina are stacked, yoke lamina 32 again bend at edge 62 of yoke spacer 56 to accommodate the "extra" leg lamination and yoke spacer. This produces another void 62A. It should be noted at this point that the length of yoke spacer 56 along the yoke portion (i.e. dimension "L") for this layer is shorter than the preceeding center layer. In accordance with an important aspect of the present invention, the variation with stack position of yoke spacer lamina length "L" causes the voids 62A in the layers to be substantially equal. This contrasts with the results in prior art transformers in which yoke spacer lamina (or leg laminations in the absence of yoke spacer lamina) have constant lengths along the transition area. In such prior art transformers, it has been found that the voids tend to "accumulate" or "add-up" due in part to the cooperation of lamina resilience and the weight distribution of the lamina. This variation of void size within the core has been found to cause a marked "sag" in the core laminations in the transition regions. As mentioned above, the creation of such variable sized voids and "sagging" in stacked-array laminar cores produces several undesirable results such as increased core noise, variation of core density, and less than maximum flux passage. Alternate stacks of lamina are thus stacked in the same manner to form the cores 16 and 14. Periodic insertion of additional leg lamina and yoke spacer lamina in the portion of the core that is external of the coils 12 provides, the reduced inside leg core structure illustrated in FIG. 1.

As is apparent in FIG. 3, each succeeding yoke spacer lamination 56 in the center-to-top portion of the core is of slightly smaller length (dimension "L") than that which is in the layer beneath. It has been found that this type of length variation greatly reduces the above-described "sagging" found in prior art laminated core transformers.

As mentioned the lower half of the stacked-array of core lamina in FIG. 3 "mirror" the upper half. Accordingly the progression of layers from the center down is the same as that described above for the center up stacking. Of particular importance is the similar variation of length of yoke spacer 56 as one progresses downward from the center layer of the core. In other words the length ("L") of yoke spacer lamina 56 varies smoothly between a maximum of the two spacers adjacent the center yoke lamina and equal minima adjacent the outermost yoke lamina. While the foregoing discussions described the arrangement of core lamina from the center-to-top and then from the center-to-bottom, it should be clear that this sequence is for convenience and clarity of description only and is not the actual stacking sequence during core fabrication. In addition it will be apparent to practitioners in the art that the bottom surface of the core is supported during assembly by an appropriately contoured surface, that is, a surface which is raised in the center portion and properly sloped in the transition regions.

In accordance with well-known methods of transformer fabrication the respective lamina of cores 14 and 16 are formed such that adjoining lamina overlap very slightly. This overlap is illustrated in FIGS. 2 and 3. For example, it can be seen in FIG. 2 that yoke lamina 28 is constructed so that edge 70 is formed at a 45-degree angle at the corner 71 of core 14. However, edge 72 extends beyond the corner 74 of core 14. Yoke lamina 44 is formed so that edge 76 intersects corner 74 but edge 78 extends beyond corner 71 of core 14. This slight overlapping of adjoining groups of lamina enhance the magnetic flux flow through the transformer since, as is well known in the transformer art, magnetic flux will not easily jump across the narrow edge junction 60 between the butting end edges of the lamina. Rather, the flux flows around these junctions as illustrated by the arrows A and B in FIG. 3. Thus, while the flux will flow through the insulation on the lateral surfaces of the lamina, it will not flow without great resistance across the end junctions. Consequently, by slightly overlapping alternate groups of lamina, flux flow is substantially enhanced. Accordingly, the length variation of yoke spacer members 56 which as mentioned are formed of grain-oriented steel aids in flux transfer at the lamination junctions by providing another lateral surface "bridging" the junction through which the flux can flow.

The present invention may be utilized in connection with either single-phase or multi-phase transformers. Further, while a typical shell-form transformer has been illustrated, the techniques described are equally applicable to core-form transformers as well.

Figure 4:
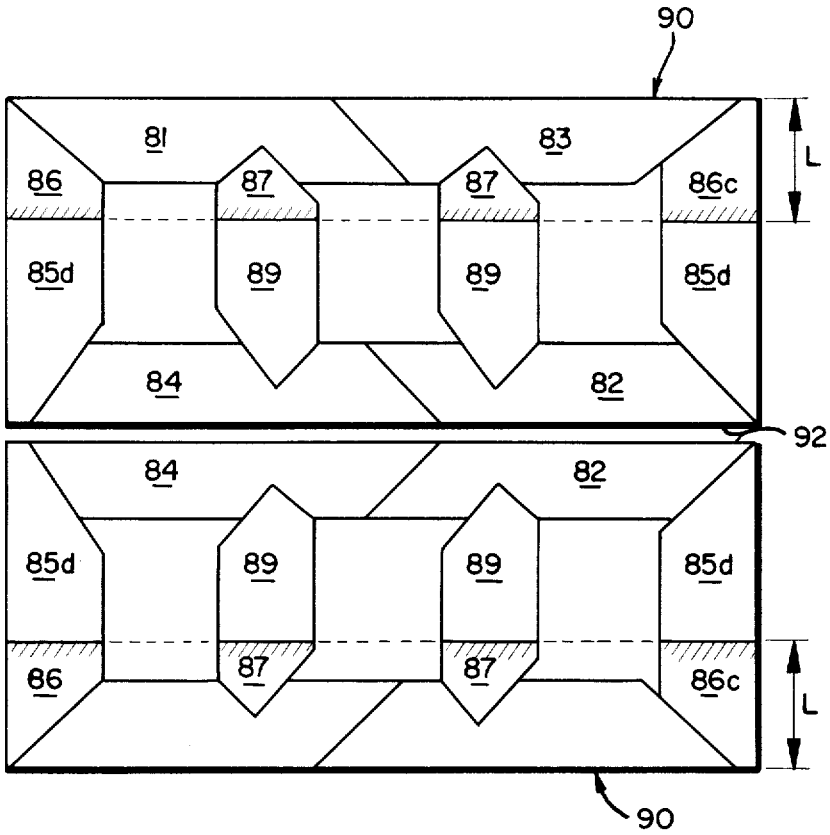
FIGS. 4–21 are illustrations of the various levels of stacked lamina in a core of a typical shell-form transformer constructed in accordance with the method of present invention.
Figure 6:
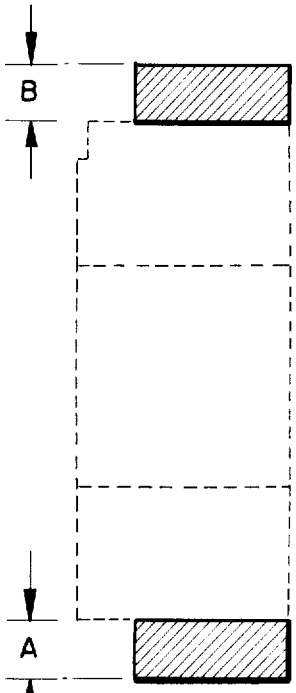
Figure 5:
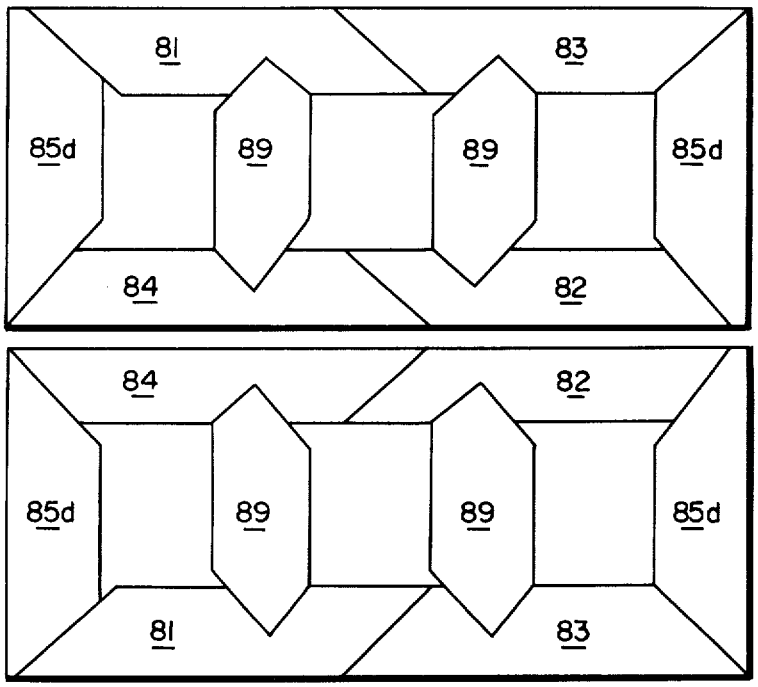
Figure 6A:
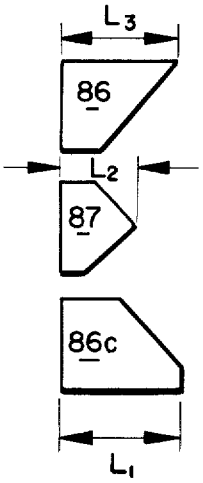

With reference to FIGS. 4–21, the method of construction and structure of a three-phase shell-form transformer core in accordance with the present invention is illustrated. With particular reference to FIGS. 4, 5 and 6, the first level of the transformer core is constructed by stacking three each of leg lamina 81 and 83 to start outside legs 90 and two each of leg lamina 82 and 84 and two each of yoke lamina **85*d* and 89 as shown to start inside legs 92. Yoke spacer lamina 86, 86*c* and 87 are then stacked on top of yoke lamina 85*d* and 89 respectively adjacent to leg lamina 81 and 83 as illustrated in FIG. 4. With reference to FIG. 6*a*, the relative shapes of lamina 86, 86*c*, and 87 are illustrated. All lamina are relatively thin and fabricated from grain-oriented steel. In addition, each yoke spacer lamination has a dimension "L" ($L_1$ for 86*c*, $L_2$ for 87 and $L_3$ for 86) which is selected for each layer to result in the desired yoke spacer length. This dimension designated as "L" in FIGS. 2 and 4 is most properly interpreted as the distance from the outside edge of the lamination stack to the inner edge of the yoke spacer laminations. As can be seen in FIG. 6*a*, the alignment of this edge requires, in the embodiment shown, that yoke spacers 87 actually have a different length than spacers 86 and 86*c*** in each layer of the core.

With reference to FIG. 5, the respective arrangement of the yoke and leg lamina are illustrated for the next layer of stacking. Three each of leg lamina 81, 82, 83 and 84 are stacked as shown and yoke lamina **85*d* and 89 are stacked as shown. It should be noted that yoke lamina 85*d* and 89 are turned 180° with respect to their arrangement in FIG. 4** so that the adjoining layers overlap along their edges to enhance magnetic flux transfer.

With respect to FIG. 6, the stacking arrangement illustrated in FIGS. 4 and 5 are utilized for alternative layers to fill up levels A and B in FIG. 6 (shown in cross-hatch). It should be clear that in each alternate layer having a yoke spacer group, their lengths differ from other layers according to the above-described pattern. Of course, level B cannot be stacked until the remaining lower levels of the transformer (shown in dotted lines) have first been stacked.

Figure 7:
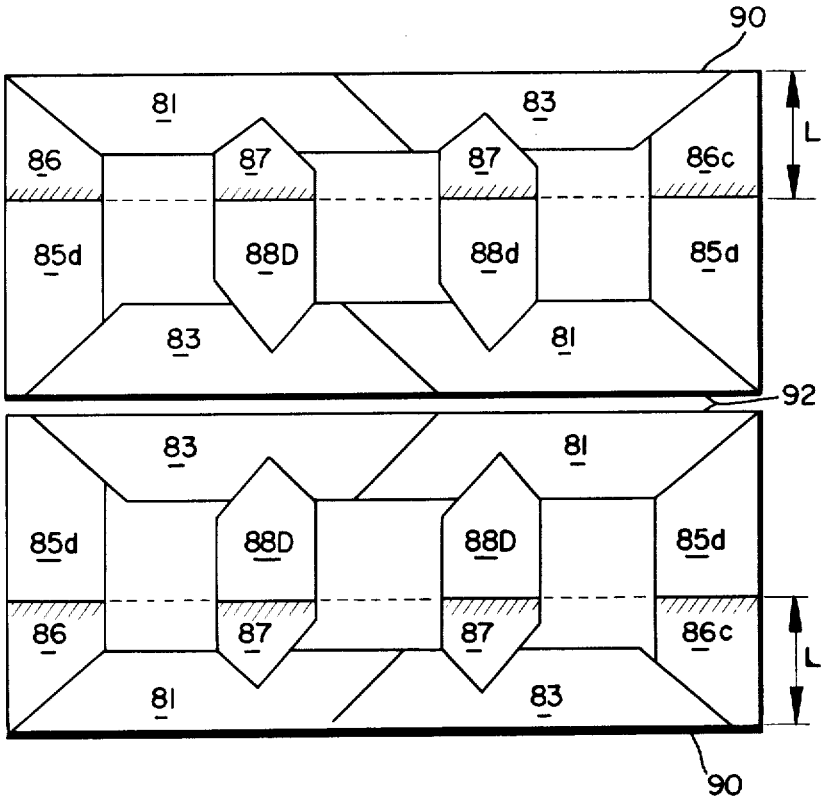
Figure 9:
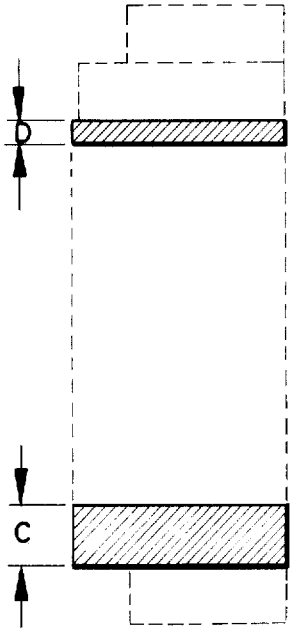
Figure 8:
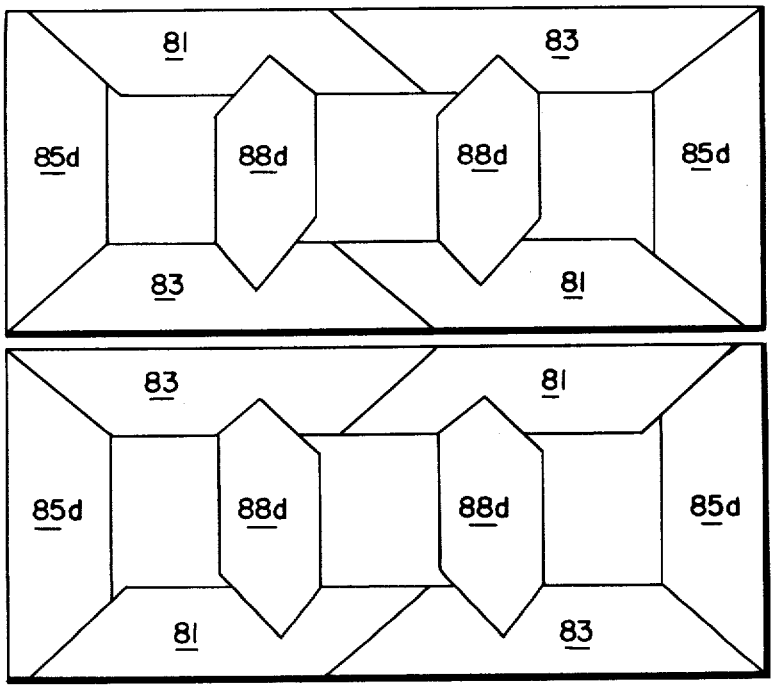

With reference to FIGS. 7, 8 and 9, the stacking arrangement for levels C and D of the core are shown (see FIG. 9). Leg lamina 81 and 83 are stacked such that three each of lamina 81 and 83 are stacked on the exterior legs 90 and two each of lamina 81 and 83 are stacked on the interior legs 92. Yoke spacer lamina 86, **86*c* and 88*d* are stacked as shown. With reference to FIG. 8, on top of the lamina stacked in accordance with FIG. 7, three each of yoke lamina 81, 83, 85*d* and 88*d* are stacked as shown. Alternate layers of lamina are stacked one on top of the other in accordance with FIGS. 7 and 8 to fill up levels D and C as shown in FIG. 9. Again the dimension "L" of yoke spacers varies during stacking as mentioned above. Leg lamina 81 and 83 stacked in inside leg 92 are wider than leg lamina 82 and 84 stacked in inside leg 92 in FIGS. 4 and 5 so that upper and lower corners of the core are recessed to facilitate coil winding around the inside legs 92**.

Figure 10:
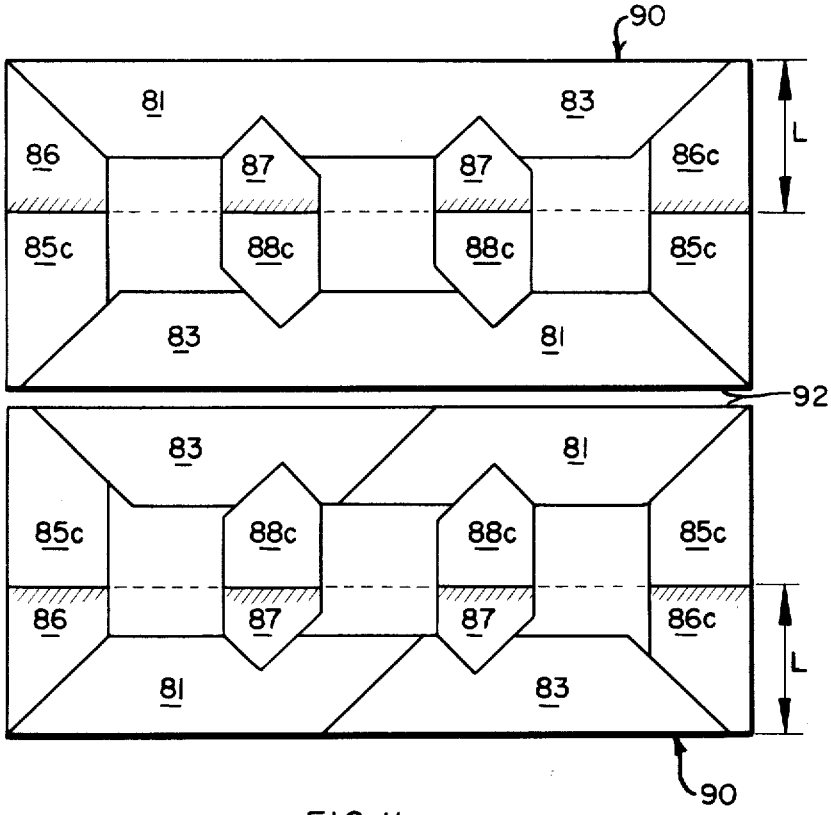
Figure 12:
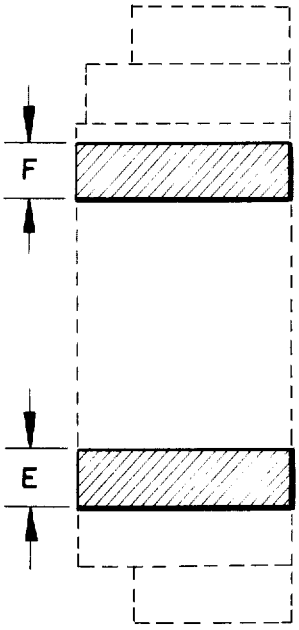
Figure 11:
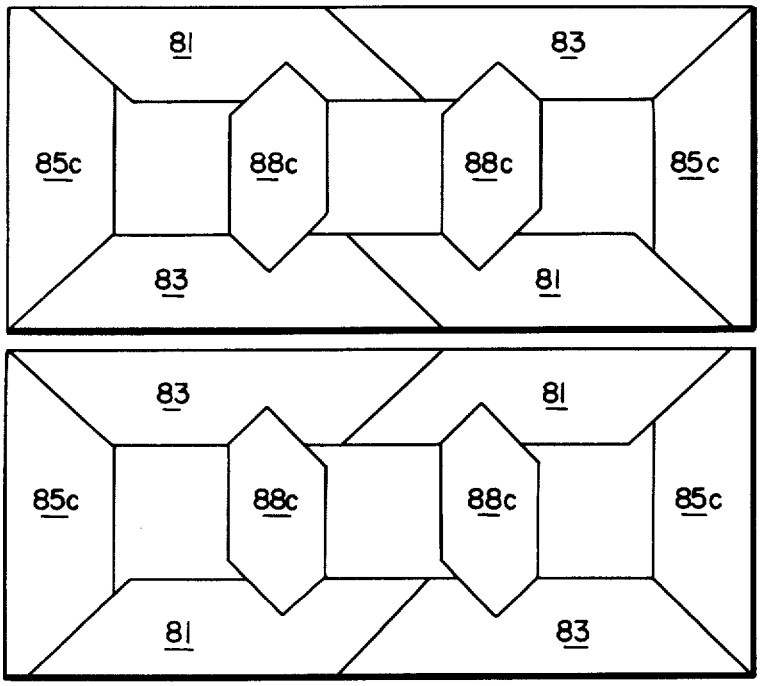

With reference to FIGS. 10, 11 and 12, the stacking arrangement for levels E and F of the transformer core are illustrated. Three each of leg lamina 81 and 83 are stacked on the outside legs 90 of the core as shown in FIG. 10 and two each of leg lamina 81 and 83 are stacked on the inside legs 92. Yoke lamina **85*c* and 88*c* are stacked as shown between legs 90 and 92. Yoke spacer member 86, 86*c* and 87 are stacked as shown adjacent to the leg lamina 81 and 83 in outside legs 90. The alternate layer comprises the lamina 81, 83, 85*c* and 88*c* illustrated in FIG. 11 stacked as shown. These alternate layers are stacked with the dimension "L" of the yoke spacers varying in each succession layer until levels E and F in FIG. 12** are filled up.

Figure 13:
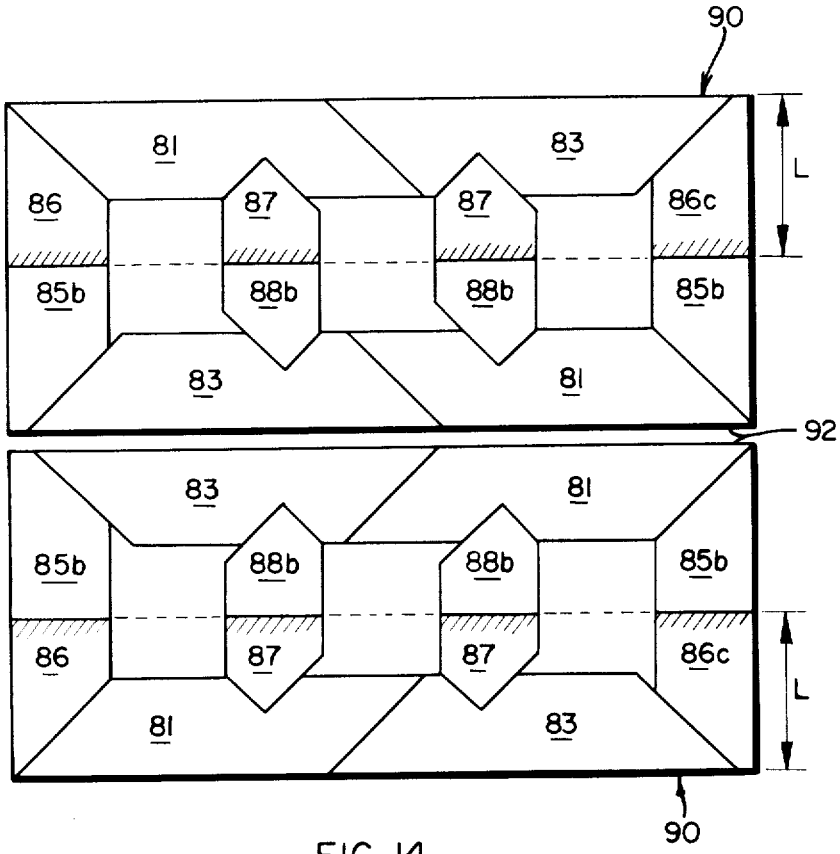
Figure 15:
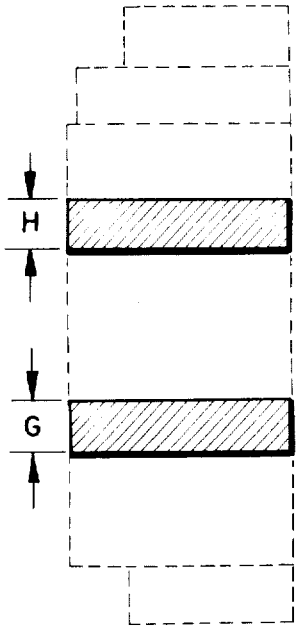
Figure 14:
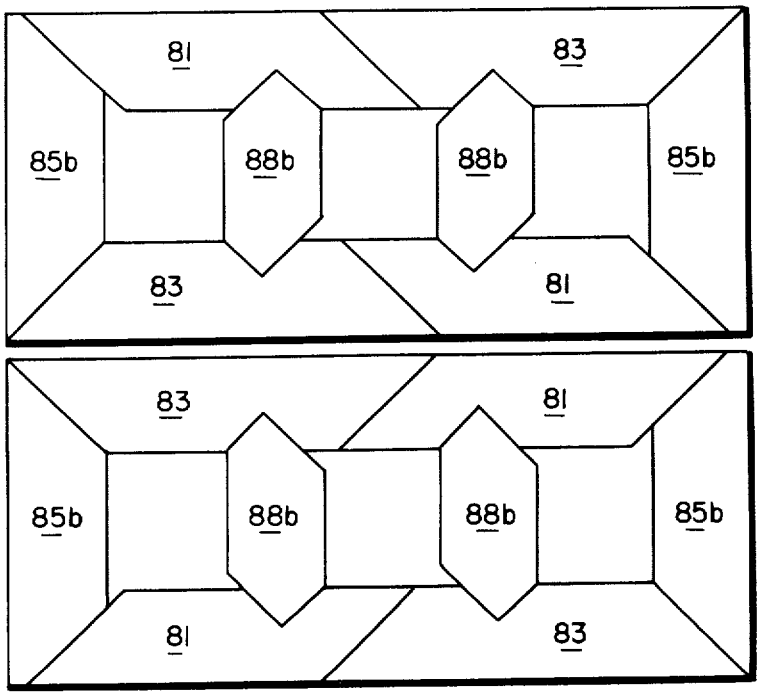

With reference to FIGS. 13, 14 and 15, the stacking of the lamina for levels G and H are shown. With reference to FIG. 13, three each of leg lamina 81 and 83 are stacked on the outside legs 90 and two each of leg lamina 81 and 83 are stacked on the inside legs 92. Yoke lamina **85*b* and 88*b* are stacked as shown and yoke spacer lamina 86, 88*c* and 87 are stacked adjacent the outside leg lamina 81 and 83 as shown. The alternate layer of lamina 81 and 83 and yoke lamina 85*b* and 88*b*** as shown. These alternate layers are stacked with yoke spacer length "L" being varied until levels G and H of the core are filled up.

Figure 16:
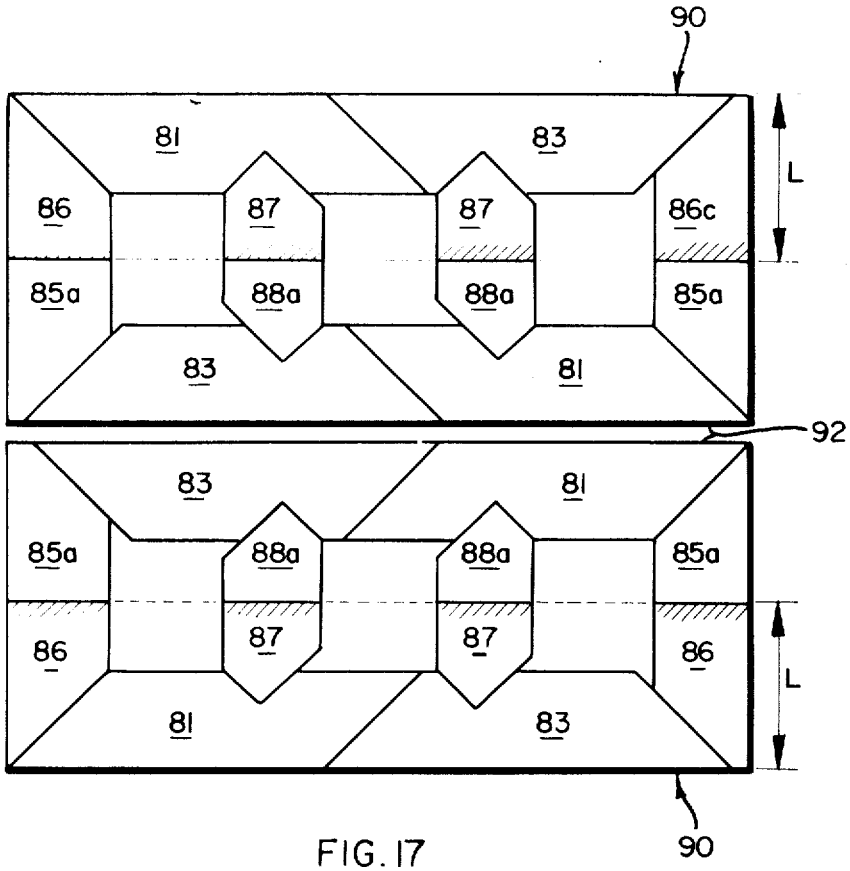
Figure 18:
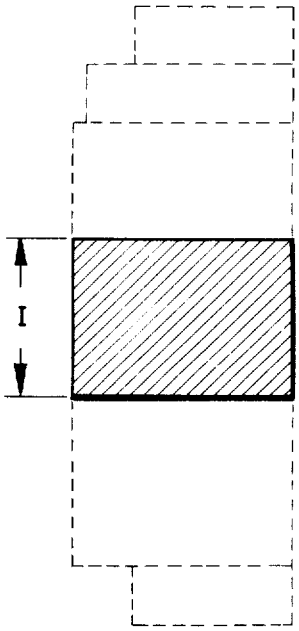
Figure 17:
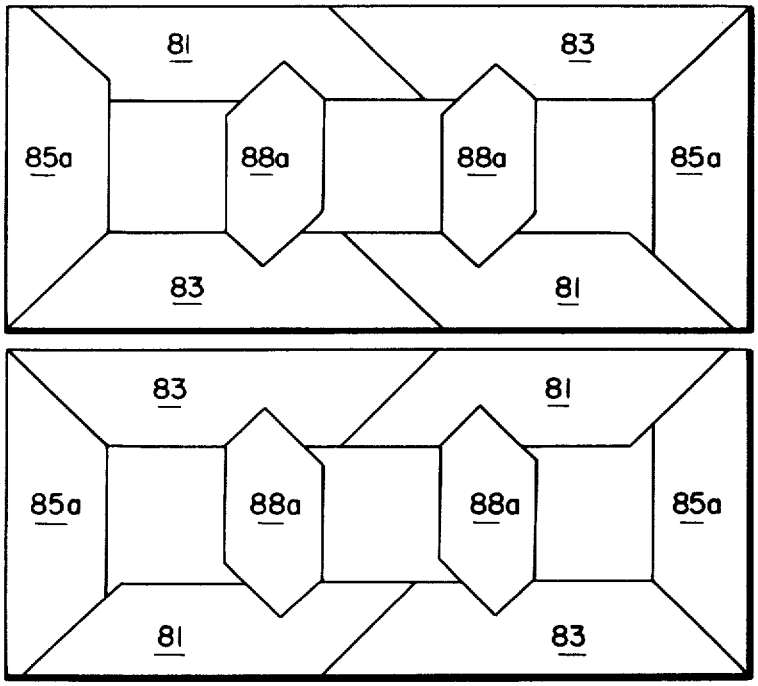

With reference to FIGS. 16, 17 and 18, the stacking arrangement of the lamina for level I of the transformer core is illustrated. Two each of leg lamina 81 and 83 are stacked on the inside legs 92 and three each of leg lmaina 81 and 83 are stacked on outside leg 90. Yoke lamina **85*a* and 88*a* are stacked as shown and yoke spacers lamina 86, 86*c* and 87 are stacked adjacent outside legs 90 as shown in FIG. 16. The alternate layer is illustrated in FIG. 17 and comprises three each of leg lamina 81 and 83 and yoke lamina 85*a* and 88*a* stacked as shown. At the center of the stack one layer of yoke laminar is straight and is "flanked" by the yoke spacers having the maximum dimension "L". (See also FIG. 3**).

Figure 19:
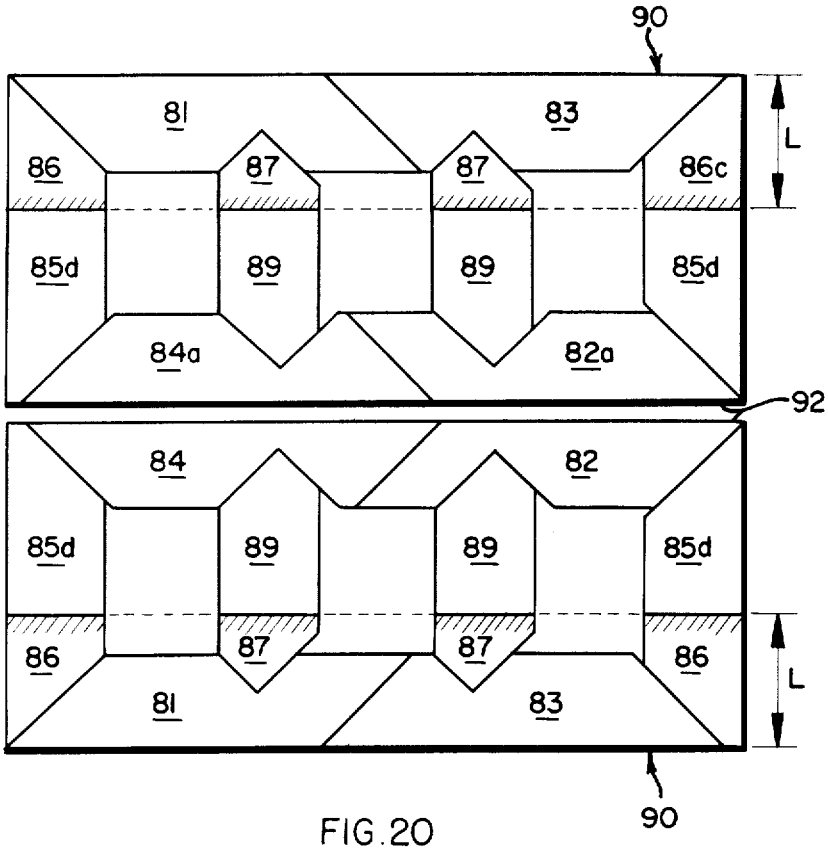
Figure 21:
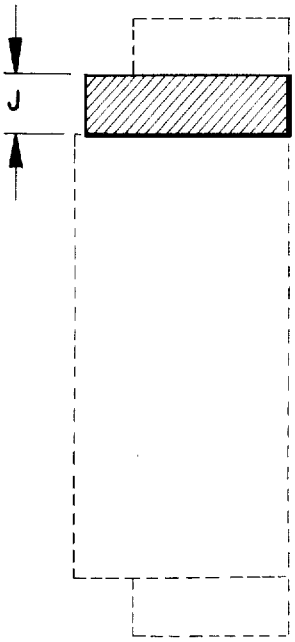
Figure 20:
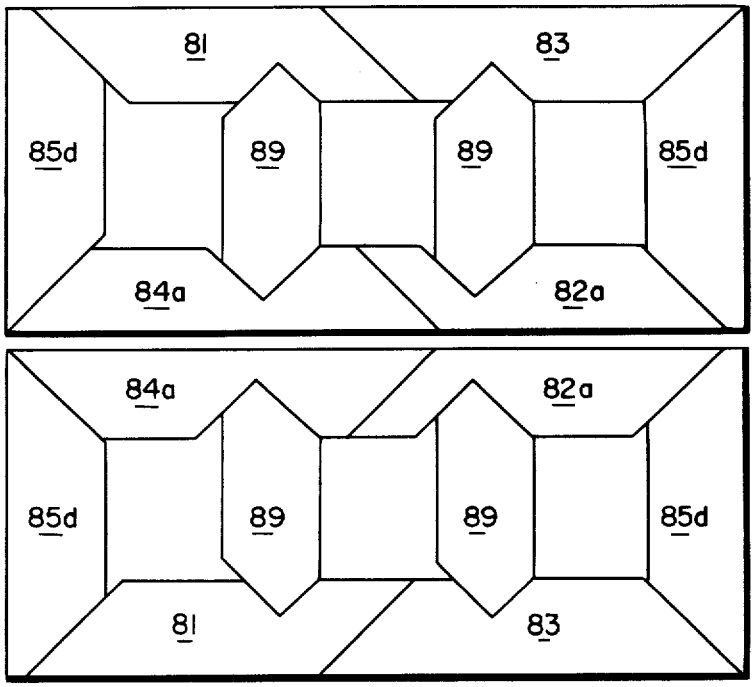

With reference to FIGS. 19, 20 and 21, the stacking arrangement for level J of the transformer core is illustrated. In FIG. 19, three each of leg lamina 81 and 83 are stacked on the outside legs 90 and two each of leg lamina **84*a* and 82*a* are stacked for the inside legs 92**.

Leg lamina 82*a* and 84*a* are not as wide as leg lamina 81 and 83 to permit a rounding or tapering effect of the core all illustrated in FIG. 21 to facilitate coil winding. Two each of yoke lamina 85*d* and 89 are stacked as shown in FIG. 16 and yoke spacer members 86, 86*c* and 87 are stacked adjacent the outside leg lamina as shown. The alternate layer of lamina is illustrated in FIG. 20 and comprises three each of leg lamina 81, 83, 82*a* and 84*a* and yoke lamina 85*d* and 89. These alternate layers are stacked until the entire level J is filled up. Again, it should be noted that the length of yoke spacer lamina is selected to fit the desired length variation pattern for the lamination stack.

It can be seen that by following the stacking arrangement illustrated in FIGS. 4–21, a power transformer core tapered as illustrated in FIG. 1 can be stacked in which the yoke spacer lamina are sized and arranged within the stacked lamination array to minimize voids, and prevent the "sagging" of laminations common to prior art structures. It should also be apparent that various stacking arrangements can be utilized in accordance with the present invention without departing from the spirit and scope of the present invention as defined in the appended claims.

While particular embodiments of the invention have been shown and described, it will be apparent to those skilled in the art that changes and modifications may be made without departing from the invention in its broader aspects, and, therefore the aim in the appended claims is to cover all such changes and modifications as fall within the true spirit and scope of the invention.

What is claimed is:

1. A transformer comprisng:

a magnetic core formed of a stacked array of laminations defining a magnetic flux path including first and second leg portions and first and second yoke portions;

a plurality of conductive coils encircling at least a part of said first leg portion;

a plurality of additional leg laminations, interleaved between selected ones of said stacked array laminations in at least a part of said second leg portion; and a plurality of yoke spacer laminations interleaved between selected ones of said stacked array of laminations in direct correspondence to said interleaving of said additional leg laminations, to minimize voids created between said core laminations by said interleaving of said additional leg laminations, said yoke spacer laminations having a dimension orthogonal to said second leg portion which varies between a maximum at the approximate center of said stacked array and minima at the extremes of said stack.

2. A transformer as set forth in claim 1 wherein said yoke spacer laminations each define a first edge adjacent said additional leg lamination and a second edge most remote from said additional leg lamination and wherein said second edges of said yoke spacers in each layer are colinear.

3. A transformer as set forth in claim 2 wherein said lamination of said core, said additional leg laminations and said yoke spacer laminations are all fabricated of grain-oriented steel.

4. A transformer as set forth in claim 3 wherein said transformer is a shell form transformer.

5. A transformer as set forth in claim 3 wherein said transformer is a core form transformer.

6. In a magnetic core in which a plurality of laminations are combined in a stacked array to form a magnetic flux path including first and second leg portions together with first and second yoke portions and in which the cross-sectional area of said second leg portion is increased relative to said first leg portion by interleaving a plurality of additional leg laminations between selected ones of said laminations, the improvement comprising:

a plurality of yoke spacer laminations in said stacked array having a dimension orthogonal to said second leg portion which varies between a maximum at the approximate center of said stacked array and minima at the ends of said stacked array.

7. A magnetic core as set forth in claim 6 wherein said plurality of lamination, said additional leg lamination, and said yoke spacer laminations are formed of grain-oriented steel.

* * * * *